US009567940B2

(12) United States Patent
Genter et al.

(10) Patent No.: US 9,567,940 B2
(45) Date of Patent: Feb. 14, 2017

(54) ENGINE ARRANGEMENT FOR ENHANCED COOLING

(71) Applicant: Cummins Inc., Columbus, IN (US)

(72) Inventors: David Paul Genter, Columbus, IN (US); Keith A. Gunter, Long Buckby (GB); Ian W. McGiffen, Scipio, IN (US); Joseph A. Worthington, Greenwood, IN (US)

(73) Assignee: CUMMINS INC., Columbus, IN (US)

( * ) Notice: Subject to any disclaimer, the term of this patent is extended or adjusted under 35 U.S.C. 154(b) by 0 days.

(21) Appl. No.: 14/729,346

(22) Filed: Jun. 3, 2015

(65) Prior Publication Data

US 2015/0267635 A1 Sep. 24, 2015

Related U.S. Application Data

(63) Continuation of application No. 13/414,473, filed on Mar. 7, 2012.

(60) Provisional application No. 61/450,019, filed on Mar. 7, 2011.

(51) Int. Cl.

| | |
|---|---|
| ***F02F 1/10*** | (2006.01) |
| ***F02F 1/00*** | (2006.01) |
| ***F02F 3/26*** | (2006.01) |
| ***F02F 1/16*** | (2006.01) |
| ***F02F 3/22*** | (2006.01) |

(52) U.S. Cl.

CPC ..... *F02F 1/004* (2013.01); *F02F 1/16* (2013.01); *F02F 3/22* (2013.01); *F02F 3/26* (2013.01)

(58) Field of Classification Search

USPC ..... 123/41.72, 41.79, 83, 41.84, 271, 669

See application file for complete search history.

(56) References Cited

U.S. PATENT DOCUMENTS 4,941,440 A * 7/1990 Weber ..... F02B 23/0696 123/193.6

6,328,001 B1 * 12/2001 Kirtley ..... F02B 23/0696 123/193.3

* cited by examiner

*Primary Examiner* — Hung Q Nguyen

*Assistant Examiner* — Ruben Picon-Feliciano

(74) *Attorney, Agent, or Firm* — Faegre Baker Daniels LLP

(57) ABSTRACT

A cylinder liner and piston configuration for an internal combustion engine includes features for improving the cooling of the piston. Specific ratios and dimensions are included to optimize the features of the cylinder liner and piston. Also included are unique piston features that assist in achieving some of the specified dimensions and ratios.

23 Claims, 1 Drawing Sheet

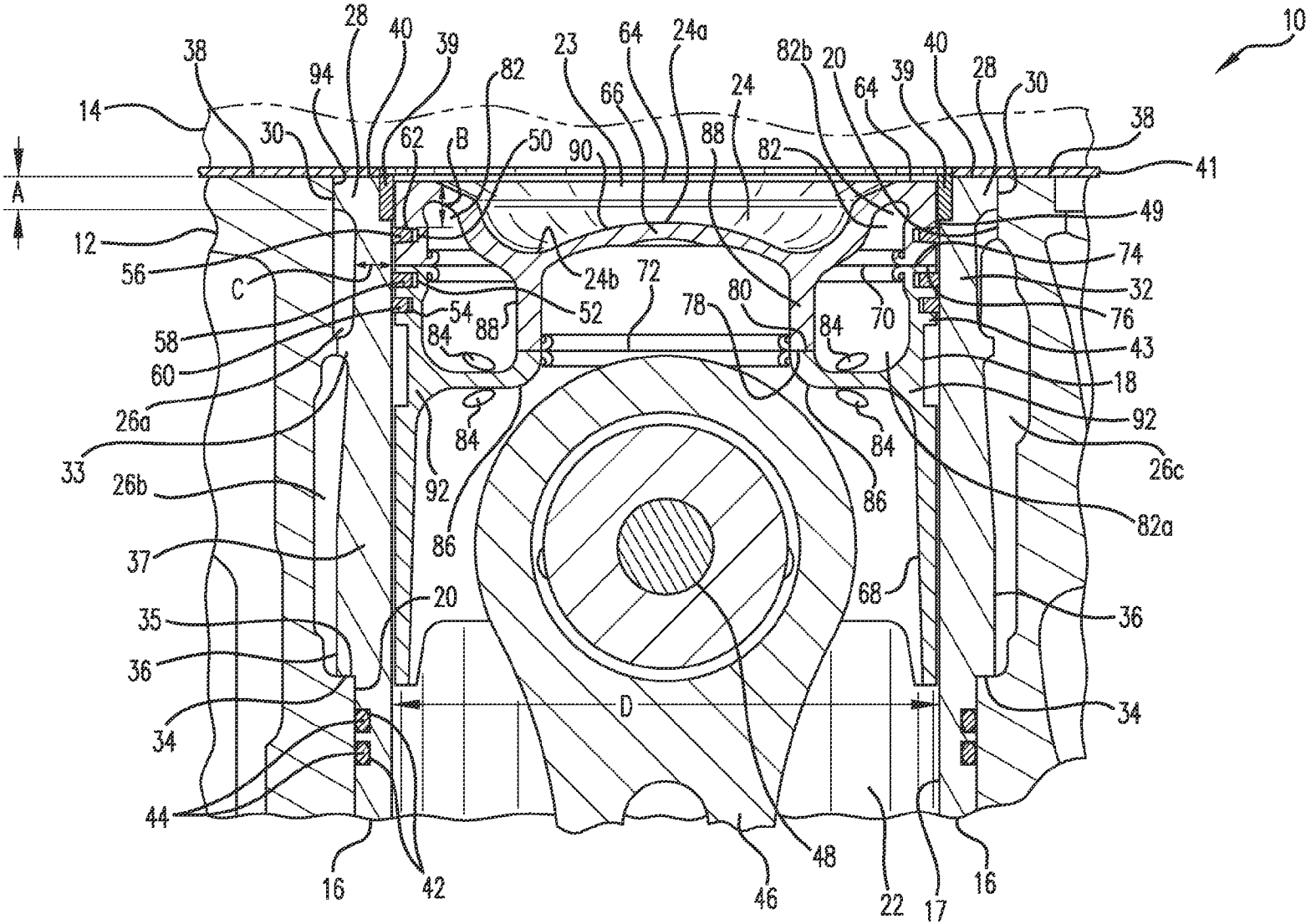
10
41
38
49
74
32
76
43
18
92
26c
82a
36
34
30
28
40
39
64
20
82b
82
24
88
24a
64
66
23
90
50
82
B
39
62
40
28
94
30
38
14
12
56
C
58
60
26a
26b
33
37
35
36
34
44
16
42
20
86
84
92
88
54
52
24b
72
78
80
84
70
68
17
22
16
48
46
D
A

ENGINE ARRANGEMENT FOR ENHANCED COOLING

PRIORITY

This application claims the benefit of priority to U.S. Non-Provisional patent application Ser. No. 13/414,473, filed on Mar. 7, 2012 which claims priority to U.S. Provisional Patent Application No. 61/450,019, filed on Mar. 7, 2011, both of which are hereby incorporated by reference in their entirety.

TECHNICAL FIELD

This disclosure relates to piston and cylinder liner configurations for internal combustion engines.

BACKGROUND

Internal combustion engines are subject to government regulations and customer expectations. Government regulations include reducing emissions and improving engine efficiency to reduce fuel consumption. Customer expectations include improved engine reliability and longer engine life. While great strides have been made in addressing government regulations and improving the life of internal combustion engines, internal combustion engines are highly complex mechanisms and innovative approaches to engine components may yield life, reliability, and efficiency improvements.

SUMMARY

This disclosure provides an internal combustion engine comprising an engine body, a cylinder bore, a cylinder liner, and a piston. The cylinder bore is formed within the engine body and has at least one coolant passage located radially outward from the cylinder bore. The cylinder liner is positioned within the cylinder bore and has an internal diameter D. The piston is positioned within the cylinder liner to reciprocate along an axis. The piston includes a top surface, an outside wall having an outer peripheral surface, and a groove positioned an axial distance B from the top surface. A ratio of distance B to internal diameter D is less than 0.090.

Advantages and features of the embodiments of this disclosure will become more apparent from the following detailed description of exemplary embodiments when viewed in conjunction with the accompanying drawings.

BRIEF DESCRIPTION OF THE DRAWINGS

FIG. 1 is a sectional view through a portion of an internal combustion engine in accordance with an exemplary embodiment of the present disclosure.

DETAILED DESCRIPTION

FIG. 1 shows an internal combustion engine 10 in accordance with an exemplary embodiment of the present disclosure. Engine 10 includes an engine body 12, only a small portion of which is illustrated, a cylinder head 14 mounted on engine body 12, at least one cylinder liner 16 positioned in engine body 12, and at least one piston 18 positioned for reciprocal movement along an axis in cylinder liner 16. Of course, engine 10 may contain a plurality of cylinder liners 16 and pistons 18, for example four to eight of each, which may be arranged in a line or in a "V" configuration. As discussed hereinbelow, engine 10 includes various precise configuration parameters that yield certain benefits, such as improved cooling of pistons 18 and cylinder liners 16, achieving improved life and reliability of engine 10, and reducing emissions and achieving improved fuel economy and efficiency from engine 10.

Engine body 12 includes at least one cylinder bore 20. Cylinder liner 16 is positioned within cylinder bore 20. Cylinder liner 16 includes an internal bore 17, having an internal diameter D, to locate piston 18. Piston 18 may be any type of piston so long as it contains the features identified hereinbelow necessary for accomplishing the present invention. For example, piston 18 may be an articulated piston. Liner 16 separates a lubricated portion 22 located at an interior portion of cylinder liner 16 and a combustion chamber 23 positioned at one end of an internal bore 17 between piston 18 and cylinder head 14 from a plurality of coolant passages 26 (e.g., 26*a*, 26*b*, 26*c*) formed in engine body 12. A combustion bowl 24 positioned in a proximate, top or upper portion of piston 18 is part of combustion chamber 23.

Combustion bowl 24 may have a plurality of features formed therein. For example, combustion bowl 24 may have a central portion 24*a* that is axially closer to cylinder head 14 than an annular portion 24*b* that extends around central portion 24*a*. These features may be related to the characteristics of combustion chamber 23, which may include fuel flow and how the fuel flow combusts or ignites (not shown). Combustion chamber 23 may have the characteristics of the combustion chamber described in U.S. Pat. No. 6,732,703, issued May 11, 2004, the entire content of which is incorporated by reference in its entirety.

Coolant passages 26 may be configured to provide optimal cooling for piston 18. For example, coolant passage 26*a* may be a high velocity coolant flow and coolant passage 26*b* may be a low velocity coolant flow. Coolant passage 26*c* may be a port that connects one part of fluid passages 26 with another part of fluid passage 26, such as coolant passage 26*a* with coolant passage 26*b*.

Cylinder liner 16 includes a top flange portion 28 having an axial or longitudinal thickness A. Cylinder liner 16 also includes an annular wall portion 32 having a radial thickness C that extends axially or longitudinally from top flange portion 28. Positioned axially further from wall portion 32 may be a protrusion 33 that cooperates with cylinder bore 20 to separate coolant passage 26*a* from coolant passage 26*b*. Included on cylinder liner 16 axially further from protrusion 33 may be a stop or step 34. A wall portion 37 is located on cylinder liner 16 and extends from protrusion 33 to stop 34. Top flange portion 28 includes an outer annular surface 30 that opposes annular cylinder bore 20. Coolant passage 26*a* is positioned radially outward from wall portion 32 on one side of cylinder liner 16 and coolant passage 26*c* is positioned radially outward from wall portion 32 on the opposite side of cylinder liner 16 from coolant passage 26*a*. Coolant passage 26*a*, coolant passage 26*b*, and coolant passage 26*c* may be part of a single coolant passage that extends angularly about cylinder liner 16.

Stop 34 located on cylinder liner 16 engages an annular land or stop 35 located on engine body 12. Stop 34 provides a location that sets the depth or offset of a proximate, near or upper surface 40 of cylinder liner 16 with respect to a top surface 38 of engine body 12. Stop 34 sets the axial length of the gap between top surface 40 of cylinder liner 16 and cylinder head 14 or a cylinder head gasket 41. A stop having similarity to stop 34 is described in U.S. Pat. No. 4,294,203, issued Oct. 12, 1981, the entire content of which is hereby incorporated by reference. One or more grooves 42 may also be positioned on an outer wall 36 of cylinder liner 14. One or more seals 44 may be positioned in each groove 42. Seals 44 separate lubricated portion 22 from coolant passages 26.

Cylinder liner 16 is inserted into engine body 12 from the top or proximate end of cylinder bore 20. The outer periphery of cylinder liner 16 is a slip fit with cylinder bore 20 in the area of cylinder liner 16 that includes grooves 42. As previously noted, seals 44 positioned within grooves 42 prevent lubricant from lubricated portion 22 from contaminating the coolant located in coolant passages 26 and prevent coolant from passages 26 from contaminating the lubricant in lubricated portion 22. Annular surface 30 of flange portion 28 is a press fit with an inner surface 94 of cylinder bore 20. The press fit may provide a seal between fluid passages 26 and combustion chamber 23 and secures cylinder liner 16 within engine body 12. A seal (not shown) may also be located between flange portion 28 and inner surface 94 of cylinder bore 20.

As previously noted, piston 18 is located within internal bore 17, which has internal diameter D, of cylinder liner 16. Piston 18 is shown in a top dead center (TDC) position in FIG. 1. Piston 18 drives a conventional connecting rod 46 attached to a pin, rod or shaft 48 secured to piston 18. Connecting rod 18 drives a crankshaft (not shown) of engine 10. Connecting rod 18 and the crankshaft cause piston 18 to reciprocate along a rectilinear path within cylinder liner 16. The TDC position is attained when the crankshaft is positioned to move piston 18 to the furthest position away from the rotational axis of the crankshaft. In the conventional manner, piston 18 moves from the TDC position to a bottom dead center (BDC) position when advancing through intake and power strokes. Piston 18 includes a plurality of grooves for piston rings and seals located on a periphery, outside diameter, or outside surface 49 of an outside wall 43 of piston 18. The plurality of grooves includes a top, upper, proximate, or first groove 50, a second, center or middle groove 52 and a third, bottom, lower, or distal groove 54. Top groove 50 includes a first conventional compression ring 56 that assists to prevent combustion gas from combustion chamber 23 from travelling between piston 18 and cylinder liner 16. An upper side 62 of top groove 50 is positioned a distance B from a top, upper, or proximate surface 64 of piston 18. Middle groove 52 includes a second conventional compression ring 58. Third groove 54 includes a conventional oil control ring 60 that limits the amount of oil that moves along internal bore 17 toward the upper or proximate end of piston 18 where combustion bowl 24 is located.

Distance B of top groove 50 is important from an emissions perspective. There is a radial gap between exterior or peripheral surface 49 of outside wall 43 of piston 18 and internal bore 17 of cylinder liner 16. Fuel that is trapped in the region between peripheral surface 49 and internal bore 17 in the region above top ring 56, which may be called a dead zone, is not combusted. This fuel becomes exposed as piston 18 moves away from the TDC position and the fuel enters an exhaust (not shown) of engine 10. Unburned fuel contributes to increased emissions and leads to less efficiency of engine 10. Thus, the ability to decrease distance B decreases emissions and improves fuel efficiency.

A scraper ring 39 may be positioned in cylinder liner 16 at an interior portion of top flange portion 28. Scraper ring 39 has an inner diameter that is smaller than the diameter of internal bore 17. Scraper ring 39 reduces the volume of the dead zone described hereinabove as well as helping to remove deposits on surface 49 of piston wall 43 above top groove 50. Thus, scraper ring 39 helps remove deposits above top or first compression ring 56.

Piston 18 is fabricated from two separate portions. An upper, proximate, or top portion 66 is joined to a lower, distal, or bottom portion 68 along a first joint 70 and a second joint 72. First joint 70 includes a surface 74 located on lower portion 68 and a matching surface 76 located on upper portion 66. First joint 70 is positioned between top groove 50 and second groove 52. Second joint 72 includes a surface 78 located on upper portion 66 and a surface 80 located on lower portion 68. Second joint 72 is axially displaced from first joint 70 in a direction that is further from combustion chamber 23 than first joint 70. By having second joint 72 in this position, a wall or rib 88, which is described in more detail hereinbelow, is readily accessible from a radial direction to form features therein, such as fluid passages (not shown). Top portion 66 and bottom portion 68 are affixed to each other through a conventional spin welding process. By fabricating piston 18 as two separate pieces, a gallery 82 may be extended, or positioned closer to top surface 64 during the fabrication of upper portion 66 since the interior of upper portion 66 is accessible prior to attaching or welding upper portion 66 to lower portion 68.

Gallery 82 has a lower portion **82*a* having a radial extent and an upper portion 82*b* having a radial extent that is less than the radial extent of lower portion 82*a*. Lower portion 82*a* extends radially from a radial distance from the central axis of piston 18, and upper portion 82*b* extends radially from a radial distance that is further from the central axis of piston 18 than lower portion 82*a* because upper portion 82*b* follows the contour of combustion bowl 24. Because upper portion 82*b* follows the contour of combustion bowl 24, the uppermost portion of portion 82*b* of gallery 82 may be located at a distance equal to the wall thickness of combustion bowl 24 from top surface 64 of combustion bowl 24. The position of the uppermost portion of portion 82*b* enables top groove 50 to be in a closer position at distance B from top surface 64 than is possible in conventional piston designs, as will be explained in more detail hereinbelow. Positioning top groove 50 at distance B provides an advantage in that heat travels a shorter distance in piston 18 before reaching a cooling fluid than in a conventional piston design. The faster access to a cooling fluid reduces heat buildup in piston 18, decreasing the stress on piston 18, which therefore increases the life of piston 18. Oil splash from connecting rod 46 goes through a plurality of piston passages 84 into gallery 82 and then back out piston passages 84 into lubricated portion 22**.

Hollowing out the interior of a conventional piston to form a gallery similar to gallery 82 is not possible because the top surface of a conventional piston would be unable to withstand the stresses in an associated combustion chamber. The reason a conventional piston is unable to withstand these stresses is because there would be insufficient support within a conventional piston to withstand the combustion pressure exerted on the top surface of a convention piston. Piston 18 overcomes this difficulty by fabricating upper piece or portion 66 and lower portion 68, forming gallery 82 into at least upper portion 66, and then welding the two portions together via a spin welding process. The outer surface or diameter 49 of piston 18 may then be machined, ground and/or honed to a desired dimension, removing any unevenness left by the spin welding process.

Passages 84 may be located in lower or distal portion 68 during casting or may be machined into lower portion 68 after casting. Wall or rib 88 located in proximate portion 66 is contiguous with a wall or rib 86 located in distal portion 68. Wall or rib 88 and wall or rib 86, because of the spin welding process, form a contiguous or continuous wall or rib that extends from a combustion bowl wall 90, which is part of combustion bowl 24, to a sidewall portion 92, which is axially below bottom groove 54. Sidewall portion 92 is part of sidewall, exterior wall, or outside wall 43 of piston 18. Thus, piston 18 has the ability to provide cooling to a peripheral portion of the top of piston 18 in a region between combustion bowl 24 and outside wall 43 of piston 18 while maintaining the strength of a conventional piston because of the two-piece piston design.

To obtain the maximum cooling, emissions and efficiency benefit from the aforementioned features, certain ratios are applicable. A first ratio is quantified in equation (1), which specifies a limit for the ratio of the top ring distance B from top surface 64 of piston 18 to piston bore diameter D. This ratio applies to piston bores having a diameter that meets the requirements of equation (2).

$$B/D<0.090 \quad \text{(Equation 1)}$$

$$275\ \text{mm} \geq D \geq 165\ \text{mm} \quad \text{(Equation 2)}$$

Distance B and diameter D are sized and dimensioned to result in a aximum ratio of 0.090, as described by equation (1), and preferably a maximum ratio of 0.085. The range of diameter D that achieves these ratios is as listed in equation (2) with a preferable range provided in equation (3).

$$275\ \text{mm} \geq D \geq 175\ \text{mm} \quad \text{(Equation 3)}$$

Meeting the requirements of equation (1) is critical to optimizing emission and reducing fuel consumption. It is apparent from equation (1) that distance B should be as close to top surface 64 of piston 18 as possible while maintaining the strength of piston 18. However, gallery 82 needs to extend to a location closer to top surface 64 of piston 18 than top groove 50. Otherwise, cooling of piston 18 in the area of top groove 50 will be inadequate, leading to excessive heating of compression ring 56, which leads to wear and early failure of cylinder liner 16. Thus, top groove 50 can be no closer to top surface 64 than gallery 82, which can only be as close to top surface 64 as the required strength of combustion bowl wall 90.

Improved cooling of piston 18 is achieved by two aspects of the present disclosure. First, distance B of top groove 50 with respect to thickness C of cylinder liner 16 in wall portion 32 determines, in part, the adequacy of cooling of piston 18. The relationship between distance B and thickness C is defined in equation (4).

$$B/C<1.30 \quad \text{(Equation 4)}$$

Distance B and thickness C are sized and dimensioned to result in a maximum ratio of 1.30 and preferably a maximum ratio of 1.25. As in equation (1), equation (4) indicates that distance B should be relatively small, at least in comparison to thickness C of wall portion 32 of cylinder 16. As previously noted, while distance B should be as small as possible, this distance is limited by the ability to cool top groove 50, which is limited by the ability to extend gallery 82 as close to top surface 64 of piston 18 as possible. The second aspect of cooling is determined by a ratio of thickness A of top flange 28 to distance B, specified in equation (5).

$$A/B<0.80 \quad \text{(Equation 5)}$$

Thickness A and distance B are sized and dimensioned to result in a maximum ratio of 0.80 and preferably a maximum ratio of 0.80. Thickness A of top flange 28 determines how close coolant passage **26*a* comes to top surface 40 of cylinder liner 16, which also limits distance B since thickness A must be no more than 0.75 times distance B. By having thickness A meet this condition, coolant is able to provide optimal cooling for top groove 50. However, thickness A has a minimum thickness determined by the ability to withstand the pressures from combustion chamber 23 and by the ability to press fit top flange 28 into cylinder bore 20. Thus, distance B is limited by two factors, the minimum thickness of top flange 28 and by the ability to make gallery 82 extend close to surface 64 of piston 18**.

Considering now equations (1)-(5), it is apparent that optimal cooling of piston 18 is achieved by meeting the requirements of equations (4) and (5), and minimum emissions and best efficiency is achieved by meeting the conditions of equations (1)-(3). The key to cylinder liner, piston ring, and piston longevity is minimizing the top ring reversal temperature. The top ring reversal temperature is the temperature of top compression ring 56 when piston 18 is at TDC and about to change direction from an upward stroke to a downward stroke. If the top ring reversal temperature is too high, then excessive wear of cylinder liner 16 and piston ring 56 occurs, shortening the life of cylinder liner 16 and piston ring 56. However, groove 50, which holds ring 56, can only be moved higher by enabling cooling of ring 56. The present disclosure describes a configuration that enables a much higher position for groove 50 and ring 56 than in conventional designs when the conditions of equations (1)-(5) are met, which improves the life and reliability of piston 18 as well as decreasing emissions and improving engine 10 efficiency.

While various embodiments of the disclosure have been shown and described, it is understood that these embodiments are not limited thereto. The embodiments may be changed, modified and further applied by those skilled in the art. Therefore, these embodiments are not limited to the detail shown and described previously, but also include all such changes and modifications.

We claim:

1. A cylinder liner, comprising:

a top portion, a mid portion, and a lower portion;

a stop located on an external surface of the mid portion;

a piston bore of diameter (D) collectively formed by the top, mid, and lower portions, the top portion having a first maximum wall thickness that is greater than a second maximum wall thickness of the lower portion; and a first portion in the top portion that is positioned to engage a top seal of a piston when the piston is at top dead center; the first portion having a wall thickness that is less than the first maximum wall thickness, wherein the first portion is positioned an axial distance (B) from a top end of the cylinder liner, wherein a ratio of distance (B) to piston bore diameter (D) is less than 0.090, and a ratio of distance (B) to the wall thickness of the first portion is less than 1.30.

2. The cylinder liner of claim 1, wherein the ratio of distance (B) to thickness of the first portion is less than 1.25.

3. The cylinder liner of claim 1, wherein the ratio of distance (B) to piston bore diameter (D) is less than 0.085.

4. The cylinder liner of claim 1, further including a top flange positioned closer to the top of the liner than the first portion is to the top of the liner.

5. The cylinder liner of claim 1, wherein the first portion is positioned an axial distance (B) from a top end of the cylinder liner, the distance (B) being between 14 mm and 24 mm.

6. The cylinder liner of claim 1, wherein the first portion is positioned an axial distance (B) from a top end of the cylinder liner, the distance (B) being less than 20 mm.

7. A cylinder liner, comprising:

a top portion, a mid portion, and a lower portion;

a stop located on an external surface of the mid portion; and the top, mid, and lower portions collectively forming a piston bore of diameter (D), the top portion having a first maximum wall thickness that is greater than a second maximum wall thickness of the lower portion, the top portion having a first portion defining a wall thickness that is less than the first maximum wall thickness of the top portion, wherein the first portion in the top portion is positioned to engage a top seal of a piston when the piston is at top dead center, wherein the first portion is positioned an axial distance (B) from a top end of the cylinder liner, wherein a ratio of distance (B) to piston bore diameter (D) is less than 0.090, and a ratio of distance (B) to the wall thickness of the first portion is less than 1.30.

8. The cylinder liner of claim 7, further including at least one ring recess defined in the top portion.

9. The cylinder liner of claim 8, wherein the first portion does not include the at least one ring recess.

10. The cylinder liner of claim 7, wherein the first portion is sized and positioned to contact fluid coolant.

11. The cylinder liner of claim 7, wherein the ratio of distance (B) to internal diameter (D) is less than 0.085.

12. The cylinder liner of claim 7, wherein the ratio of distance (B) to thickness of the first portion is less than 1.25.

13. The cylinder liner of claim 9, wherein the first portion is positioned an axial distance (B) from a top end of the cylinder liner, the distance (B) being between 14 mm and 24 mm.

14. The cylinder liner of claim 9, wherein the first portion is positioned an axial distance (B) from a top end of the cylinder liner, the distance (B) being less than 20 mm.

15. A cylinder liner, comprising:

a top portion, a mid portion, and a lower portion;

a stop located on an external surface of the mid portion;

a piston bore of diameter (D) collectively formed by the top, mid, and lower portions, the top portion having a first maximum outer diameter that is greater than a second maximum outer diameter of the lower portion; and a first portion in the top portion that is positioned to engage a top seal of a piston when the piston is at top dead center; the first portion having an outer diameter that is less than the first maximum outer diameter, wherein the first portion is positioned an axial distance (B) from a top end of the cylinder liner, wherein a ratio of distance (B) to piston bore diameter (D) is less than 0.090, and a ratio of distance (B) to the wall thickness of the first portion is less than 1.30.

16. The cylinder liner of claim 15, wherein the ratio of distance (B) to thickness of the first portion is less than 1.25.

17. The cylinder liner of claim 15, wherein the ratio of distance (B) to internal diameter (D) is less than 0.085.

18. The cylinder liner of claim 15, further including a top flange positioned closer to the top of the liner than the first portion is to the top of the liner.

19. The cylinder liner of claim 15, wherein the first portion is positioned an axial distance (B) from a top end of the cylinder liner, the distance (B) being between 14 mm and 24 mm.

20. The cylinder liner of claim 15, wherein the top portion is positioned an axial distance (B) from a top end of the cylinder liner, the distance (B) being less than 20 mm.

21. The cylinder liner of claim 1, wherein the top portion comprises a protrusion that cooperates with a cylinder bore to form a plurality of coolant passages.

22. The cylinder liner of claim 7, wherein the top portion comprises a protrusion that cooperates with a cylinder bore to form a plurality of coolant passages.

23. The cylinder liner of claim 15, wherein the first portion comprises a protrusion that cooperates with a cylinder bore to form a plurality of coolant passages.

* * * * *